US008107662B2

(12) United States Patent
Parker

(10) Patent No.: US 8,107,662 B2
(45) Date of Patent: Jan. 31, 2012

(54) PORTING

(75) Inventor: Robert Preston Parker, Westborough, MA (US)

(73) Assignee: Bose Corporation, Framingham, MA (US)

( * ) Notice: Subject to any disclaimer, the term of this patent is extended or adjusted under 35 U.S.C. 154(b) by 37 days.

(21) Appl. No.: 12/416,516

(22) Filed: Apr. 1, 2009

(65) Prior Publication Data

US 2009/0245563 A1 Oct. 1, 2009

Related U.S. Application Data

(63) Continuation of application No. 12/248,326, filed on Oct. 9, 2008, which is a continuation of application No. 10/699,304, filed on Oct. 31, 2003, now Pat. No. 7,463,744.

(51) Int. Cl.
*H04R 25/00* (2006.01)

(52) U.S. Cl. ..... 381/345; 381/164; 381/87; 381/397

(58) Field of Classification Search ..... 381/161, 381/345, 351, 353, 372, 354
See application file for complete search history.

(56) References Cited

U.S. PATENT DOCUMENTS

| | | | | |
|---|---|---|---|---|
| 4,811,403 | A | 3/1989 | Henricksen et al. | |
| 4,875,546 | A | 10/1989 | Krnan | |
| 4,903,300 | A | 2/1990 | Polk | |
| 5,012,890 | A | 5/1991 | Nagi et al. | |
| 5,109,422 | A | 4/1992 | Furukawa | |
| 5,150,471 | A | 9/1992 | Tipon et al. | |
| 5,173,575 | A | 12/1992 | Furukawa | |
| 5,261,006 | A | 11/1993 | Nieuwendijk et al. | |
| 5,357,586 | A | 10/1994 | Nordschow et al. | |
| 5,479,520 | A | 12/1995 | Nieuwendijk et al. | |
| 5,533,132 | A | 7/1996 | Button | |
| 5,792,999 | A * | 8/1998 | Arnold et al. | 181/141 |
| 6,169,811 | B1 * | 1/2001 | Croft, III | 381/186 |
| 6,275,597 | B1 | 8/2001 | Roozen et al. | |
| 6,549,037 | B1 | 4/2003 | Clark et al. | |
| 6,549,637 | B1 | 4/2003 | Risch | |
| 6,956,956 | B2 | 10/2005 | Kuratani et al. | |
| 7,103,193 | B2 | 9/2006 | Croft, III | |
| 7,123,736 | B2 | 10/2006 | Eaton | |
| 7,463,744 | B2 | 12/2008 | Parker et al. | |
| 7,711,134 | B2 * | 5/2010 | Stead et al. | 381/345 |
| 2004/0017924 | A1 | 1/2004 | Kuratani et al. | |
| 2009/0274329 | A1 | 11/2009 | Ickler et al. | |

FOREIGN PATENT DOCUMENTS

CN 1030507 A 1/1989

(Continued)

OTHER PUBLICATIONS

CN Office Action dated Dec. 18, 2009 for CN Appl. No. 200410089636.4.

Salvatti, Alex et al., Maximizing Performance from Loudspeaker Ports, presented at the 105th Convention of Audio Engineering Society on Sep. 26-28, 1998 in San Francisco, CA.

(Continued)

*Primary Examiner* — Davetta W Goins
*Assistant Examiner* — Phylesha Dabney

(57) ABSTRACT

A ported electroacoustical device uses the action of the port to provide cooling airflow across a heat producing device. The device includes a loudspeaker enclosure including a first acoustic port, and an acoustic driver, mounted in the loudspeaker enclosure. The device also includes a heat producing device. The acoustic driver and the acoustic port are constructed and arranged to coact to provide a cooling, substantially unidirectional airflow across the heat producing device, thereby transferring heat from the heat producing device.

2 Claims, 14 Drawing Sheets

FOREIGN PATENT DOCUMENTS

| | | | |
|---|---|---|---|
| DE | 3025569 | | 2/1982 |
| EP | 334238 | A2 | 9/1989 |
| EP | 336303 | A2 | 10/1989 |
| JP | 57-131069 | A | 8/1982 |
| JP | 61219289 | | 9/1986 |
| JP | 63074297 | | 4/1988 |
| JP | 1241296 | A | 9/1989 |
| JP | 1241297 | A | 9/1989 |
| JP | 06-245286 | A | 9/1994 |
| JP | 2001346283 | | 12/2001 |
| WO | 96/31105 | | 10/1996 |

OTHER PUBLICATIONS

Salvatti, et al., Maximizing Performance from Loudspeaker Ports, J. Audio Eng. Soc., vol. 50, No. 1/2, Jan.-Feb. 2002.

European Examination Report dated Jun. 18, 2007, issued in European Application No. 04105332.3 filed, Oct. 27, 2004.

JP Office Action dated Jul. 20, 2010, for JP Appl. No. 2004-315046.

CN Office Action dated Aug. 3, 2010 for CN Appln. No. 200410089636.4.

CN Decision dated Jan. 12, 2011 for CN 200410089636.4.

JP Decision dated Apr. 5, 2011 for CN Appln. No. 2004-315046.

* cited by examiner

PORTING

CLAIM OF PRIORITY

This application is a continuation of U.S. patent application Ser. No. 12/248,326, filed Oct. 9, 2008, which is a continuation of U.S. patent application Ser. No. 10/699,304, now U.S. Pat. No. 7,463,744, filed on Oct. 31, 2003, the entire contents of which are both hereby incorporated by reference in their entirety.

BACKGROUND OF THE INVENTION

The invention relates to porting and heat removal in acoustic devices, and more particularly to heat removal from ported acoustic enclosures.

It is an important object of the invention to provide an improved apparatus for porting. It is another object to remove undesired heat from an acoustic device.

BRIEF SUMMARY OF THE INVENTION

According to an aspect of the invention, an electroacoustical device, comprises a loudspeaker enclosure including a first acoustic port, an acoustic driver mounted in the loudspeaker enclosure; and a heat producing device. The acoustic driver and the acoustic port are constructed and arranged to coact to provide a cooling, substantially unidirectional airflow across the heat producing device, thereby transferring heat from the heat producing device.

In another aspect of the invention, an electroacoustical device includes an acoustic enclosure, a first acoustic port in the acoustic enclosure, an acoustic driver mounted in the acoustic enclosure for causing a first airflow in the port. The first airflow flows alternatingly inward and outward in the port. The device further includes a heat producing device. The acoustic port is constructed and arranged so that the first airflow creates a substantially unidirectional second airflow. The device also includes structure for causing the unidirectional airflow to flow across the heat producing device.

In another aspect of the invention, a loudspeaker enclosure having an interior and an exterior includes a first port having a first end having a cross-sectional area and a second end having a cross-sectional area, wherein the first end cross-sectional area is greater than the second end cross-sectional area. The first end abuts the interior, and the second end abuts the exterior. The enclosure also includes a second port. The first port is typically located below the second port.

In another aspect of the invention, a loudspeaker includes an electroacoustical transducer and a loudspeaker enclosure. The loudspeaker enclosure has a first port having an interior end and an exterior end, each having cross-sectional area. The exterior end cross-sectional area is larger than the interior end cross-sectional area. The device also includes a second port having an interior end and an exterior end. The first port is typically located above the second port.

In another aspect of the invention, a loudspeaker enclosure includes a first port having an interior end and an exterior end, each having a cross-sectional area. The first port interior end cross-sectional area is smaller than the first port exterior end cross-sectional area. The enclosure also includes a second port having an interior end and an exterior end, each end having a cross-sectional area. The second port interior end cross-sectional area is larger than the second port exterior end cross-sectional area.

In another aspect of the invention, an electroacoustical device, for operating in an ambient environment includes an acoustic enclosure, comprising a port having an exit for radiating pressure waves; an electroacoustical transducer, positioned in the acoustic enclosure, for vibrating to produce the pressure waves; a second enclosure having a first opening and a second opening; wherein the port exit is positioned near the first opening so that the pressure waves are radiated into the second enclosure through the first opening; a mounting position for a heat producing device in the first opening, positioned so that air flowing into the opening from the ambient environment flows across the mounting position.

In another aspect of the invention, an electroacoustical device includes a first enclosure having a port having a terminal point for an outward airflow to exit the enclosure to an ambient environment and for an inward airflow to enter the enclosure. The device also includes an electroacoustical transducer, comprising a vibratile surface for generating pressure waves resulting in the outward airflow and the inward airflow. The device also includes a second enclosure having a first opening and a second opening. The port terminal point is positioned near the first opening and oriented so that the port terminal outward flow flows toward the second opening. The port and the electroacoustical transducer coact to cause a substantially unidirectional airflow into the first opening.

In another aspect of the invention, an electroacoustical device, for operating in an ambient environment includes an acoustic enclosure. The enclosure includes a port having an exit for radiating pressure waves. The electroacoustical device further includes an electroacoustical transducer, positioned in the acoustic enclosure, to provide the pressure waves. The device also includes an elongated second enclosure having a first extremity and a second extremity in a direction of elongation. There is a first opening at the first extremity and a second opening at the second extremity. The port exit is positioned in the first opening so that the pressure waves are radiated into the second enclosure through the first opening toward the second opening. The device also includes a mounting position for a heat producing device in the elongated second enclosure, positioned so that air flowing into the opening from the ambient environment flows across the mounting position.

In still another aspect of the invention, an electroacoustical device includes a first enclosure having a port having a terminal point for an outward airflow to exit the enclosure and for an inward airflow to enter the enclosure. The device also includes an electroacoustical transducer, having a vibratile surface, mounted in the first enclosure, for generating pressure waves resulting in the outward airflow and the inward airflow. The device also includes a second enclosure having a first opening and a second opening. The port terminal point is positioned with the port terminal point in the second enclosure, oriented so that the port terminal outward flow flows toward the second opening. The port and the electroacoustical transducer coact to cause a substantially unidirectional airflow into the first opening.

According to an aspect of the invention, there is a loudspeaker enclosure having a loudspeaker driver and a port tube formed with a vent intermediate its ends constructed and arranged to introduce leakage resistance into the port tube that reduces the Q of at least one standing wave excited in the port tube when acoustic energy is transmitted therethrough. Venting may occur into the acoustic enclosure, into the space outside the enclosure, to a different part of the port tube, into a small volume, into a closed end resonant tube, or other suitable volume.

Other features, objects, and advantages will become apparent from the following detailed description, when read in connection with the accompanying drawing in which:

DETAILED DESCRIPTION

Figure 1:
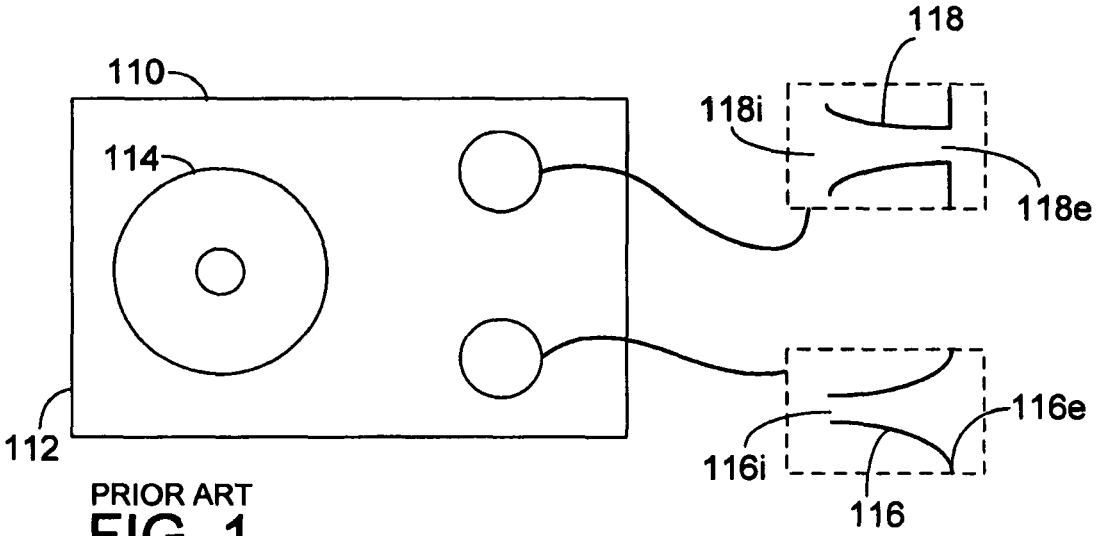
PRIOR ART FIG. 1
FIG. 1 is diagrammatic view of a prior art device.

With reference now to the drawing and more particularly to FIG. 1, there is shown a cross section of a prior art loudspeaker. A loudspeaker 110 includes an enclosure 112 and an acoustic driver 114. In the enclosure 110 are two ports 116 and 118, positioned so that one port 118 is positioned above the other. Ports 116 and 118 are flared. The upper port 118 is flared inwardly, that is, the interior end 118*i* has a larger cross-sectional area than the exterior end 118*e*. The lower port is flared outwardly, that is, the exterior end 116*e* has a larger cross-sectional area than the interior end 116*i*.

Figure 2:
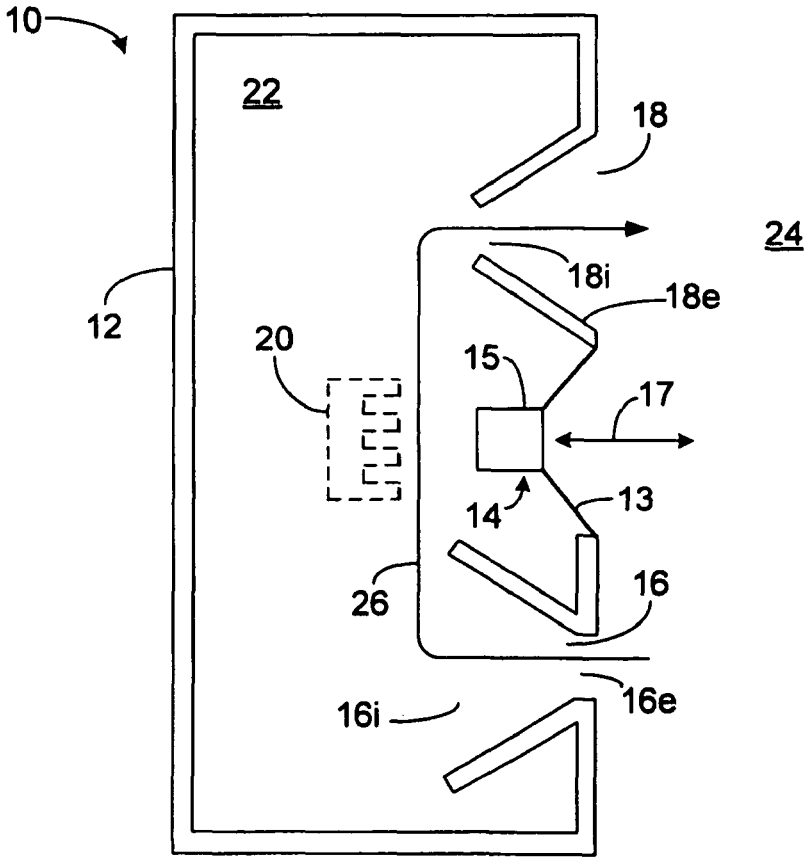
FIG. 2 is a diagrammatic view of a device according to the invention.

Referring now to FIG. 2, there is shown a cross sectional view of a loudspeaker according to the invention. Loudspeaker 10 includes an enclosure 12 and an acoustic driver 14 having a motor structure 15. In the enclosure are two ports, 16 and 18, positioned so that one port 16 is positioned lower in the enclosure 12 than the other port 18. Lower port 16 is flared inwardly, that is, interior end 16*i* has a larger cross-sectional area than the exterior end 16*e*. Upper port 18 is flared outwardly, that is, exterior end 18*e* has a larger cross-sectional area than the interior end 18*i*. For purposes of illustration and explanation, the flares of port 16 and 18 are exaggerated. Actual dimensions of an exemplary port are presented below. In the enclosure there are heat producing elements. The heat producing elements may include the motor structure 15 of the acoustic driver, or an optional heat producing device 20, such as a power supply or amplifier for loudspeaker 10 or for another loudspeaker, not shown, or both. Optional heat producing device 20 may be positioned lower than upper port 18 for better results. It may be advantageous to remove heat from motor structure 15, positioning it lower than upper port 18 for better results.

In operation, a surface, such as cone 13, of acoustic driver 14 is driven by motor structure 15 so that the cone 13 vibrates in the direction indicated by arrow 17, radiating sound waves, in this case to the exterior 24 of the enclosure and the interior 22 of the enclosure. In driving the acoustic driver cone, the motor structure 15 generates heat that is introduced into enclosure interior 22. Sound waves radiated to the interior 22 of the enclosure result in sound waves radiated out through ports 16 and 18. In addition to the sound waves radiated out through the ports, there is a DC airflow as indicated by arrow 26. The DC airflow is described in more detail below. The DC airflow transfers heat away from motor structure 15 and optional heat producing element 20 through upper port 18 and out of the enclosure, thereby cooling the motor structure 15 and the optional heat producing element 20.

Figure 3A:
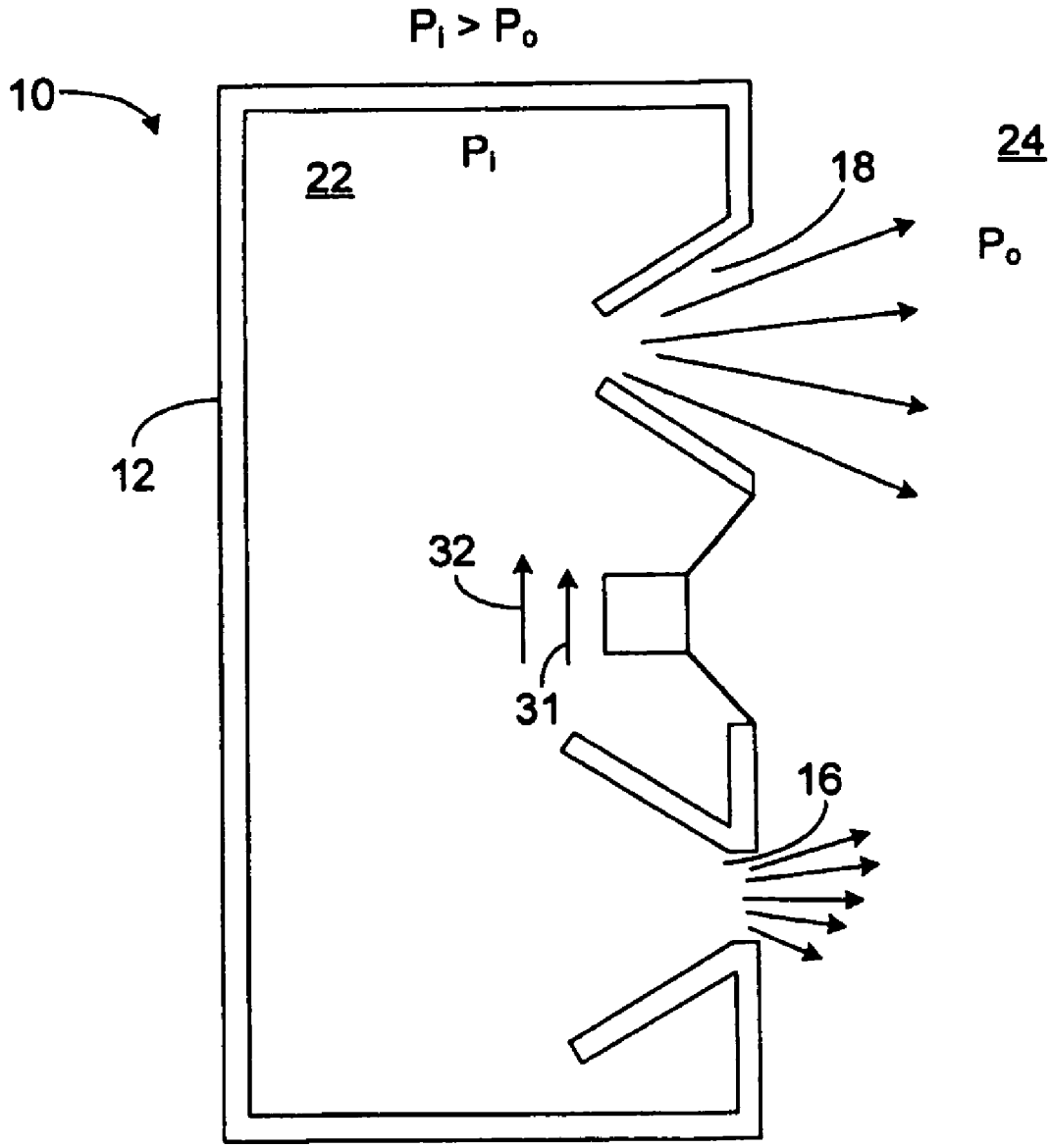
FIGS. 3A and 3B are views of the device of FIG. 2, illustrating the workings of the device.
Figure 3B:
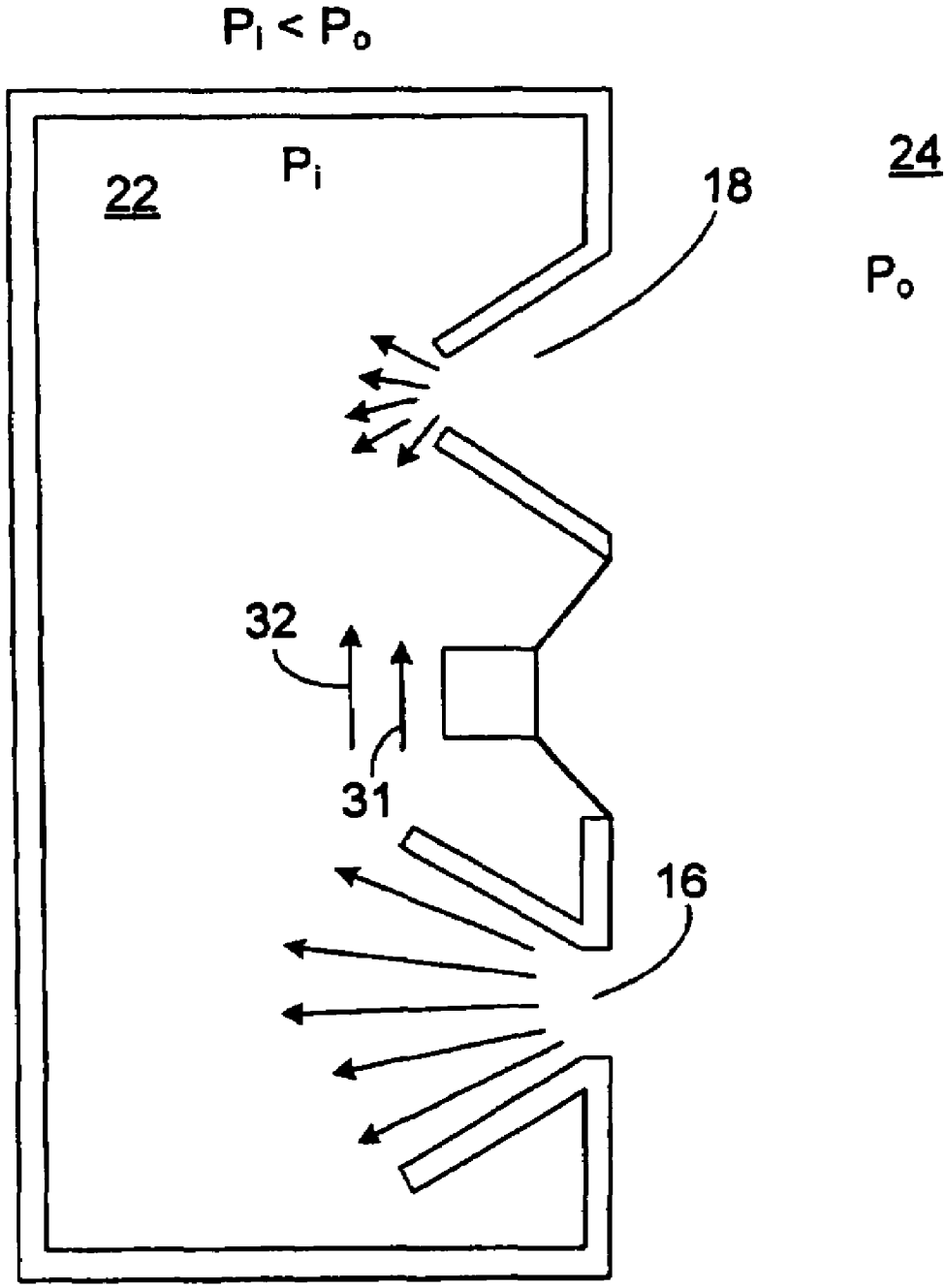

Referring to FIGS. 3*a* and 3*b*, the loudspeaker of FIG. 2 is shown to explain the DC airflow of FIG. 2. As the loudspeaker 10 operates, the air pressure $P_i$ inside the enclosure alternately increases and decreases relative to the pressure $P_o$ of the air outside the enclosure. When the pressure $P_i$ is greater than pressure $P_o$, as in FIG. 3*a*, the pressure differential urges the air to flow from the interior 22 to the exterior 24 of the enclosure. When the $P_i$ pressure is less than the pressure $P_o$, as in FIG. 3*b*, the pressure differential urges the air to flow from the exterior 24 to the interior 22. For a given magnitude of pressure across the port, there is more flow if the higher pressure end is the smaller end than if the higher pressure end is the larger end. When the airflow is from the interior to the exterior, as in FIG. 3*a*, there is more airflow through outwardly flaring port 18 than through inwardly flaring port 16, and there is a net DC airflow 31 toward outwardly flaring port 18, in the same direction as convective airflow 32. When the airflow is from the exterior to the interior, as in FIG. 3*b*, there is more airflow through inwardly flaring port 16 than through outwardly flaring port 18, and there is a net DC airflow 31 away from inwardly flaring port 16 toward outwardly flaring port 18. Whether $P_i$ pressure is less than or greater than the pressure $P_o$, there is a net DC airflow in the same direction. Therefore, as interior pressure $P_i$ cycles above and below $P_o$, during normal operation of loudspeaker 10, there is a DC airflow flowing in the same direction as the convective DC airflow 32, and the DC airflow can be used to transfer heat from the interior of the enclosure 24 to the surrounding environment.

A loudspeaker according to the invention is advantageous because there is a port-induced airflow that is in the same direction as the convective airflow, increasing the cooling efficiency.

Empirical results indicate that thermal rise of a test setup using the configuration of FIG. 1 was reduced by about 21% as compared to the thermal rise with no signal to the acoustic driver 114. With the configuration of FIG. 2, the thermal rise was reduced by about 75% as compared to the thermal rise with no signal to acoustic driver 14.

Figure 4A:
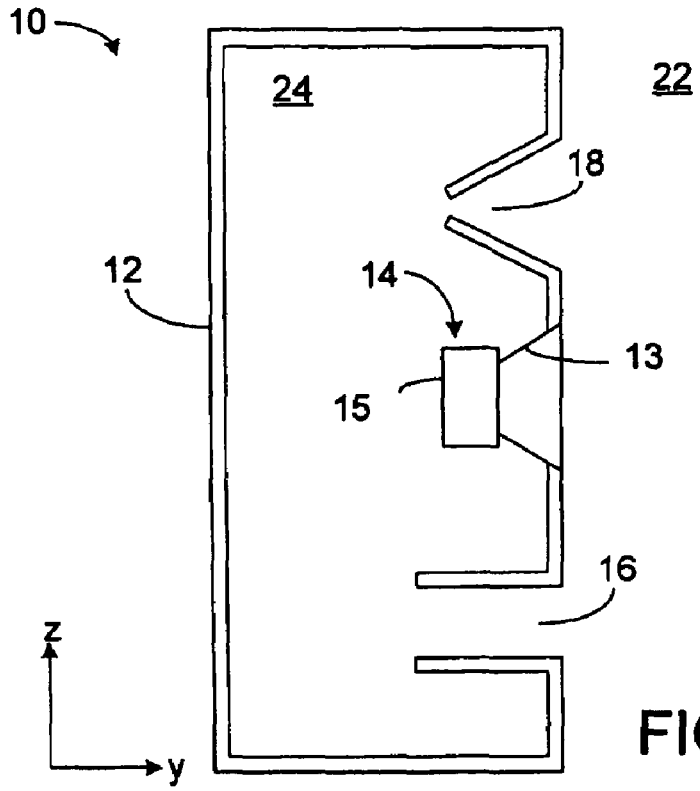
FIGS. 4A-4I are diagrammatic views of embodiments of the invention.
Figure 4B:
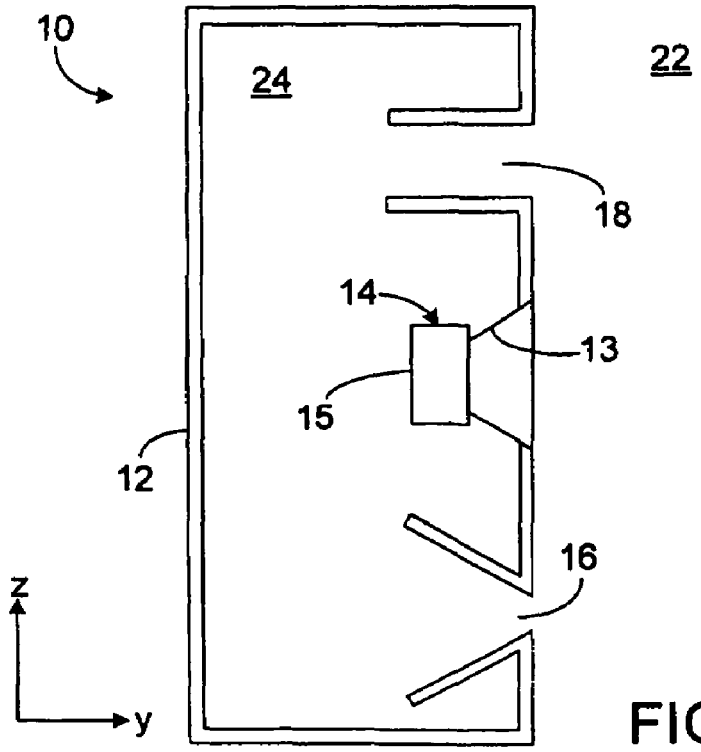
Figure 4C:
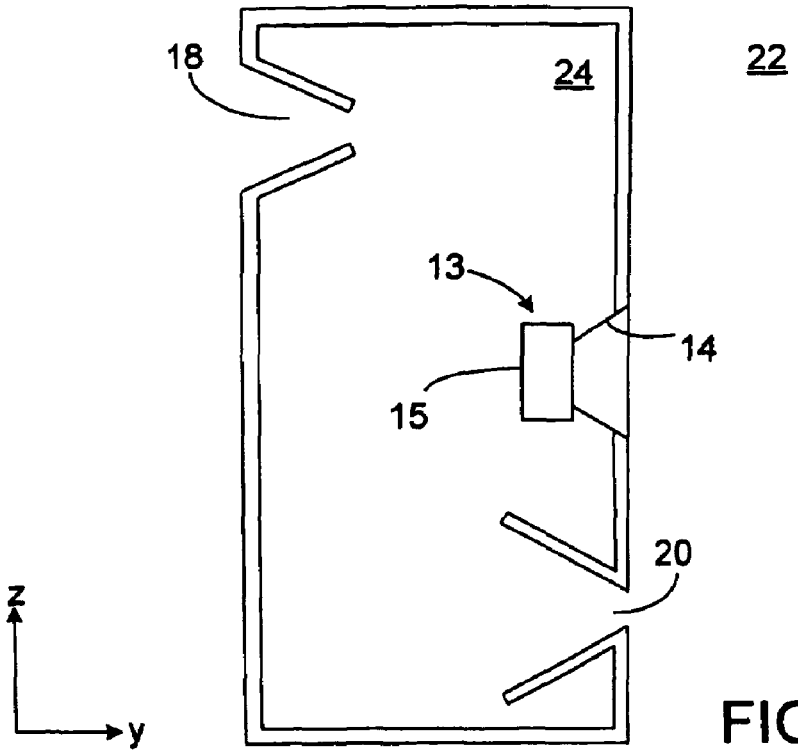
Figure 4D:
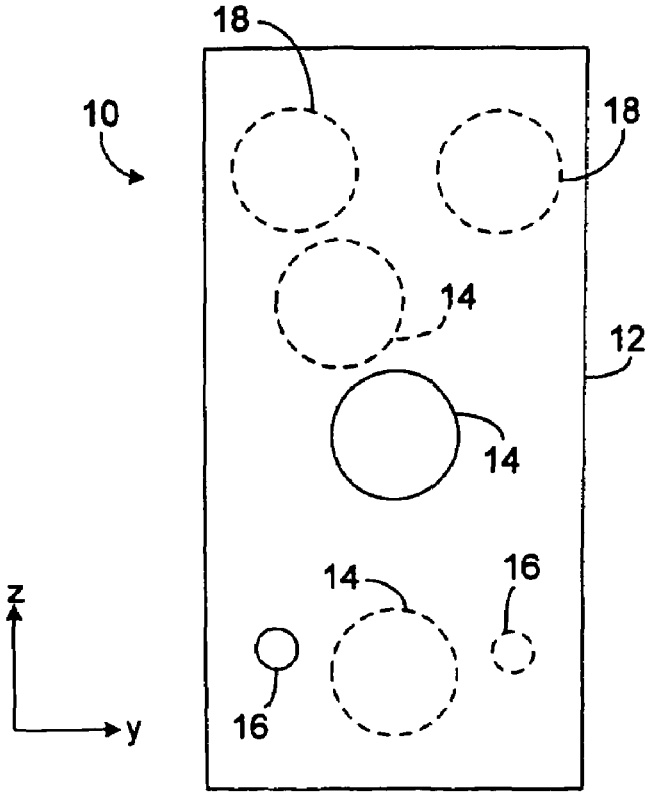
Figure 4E:
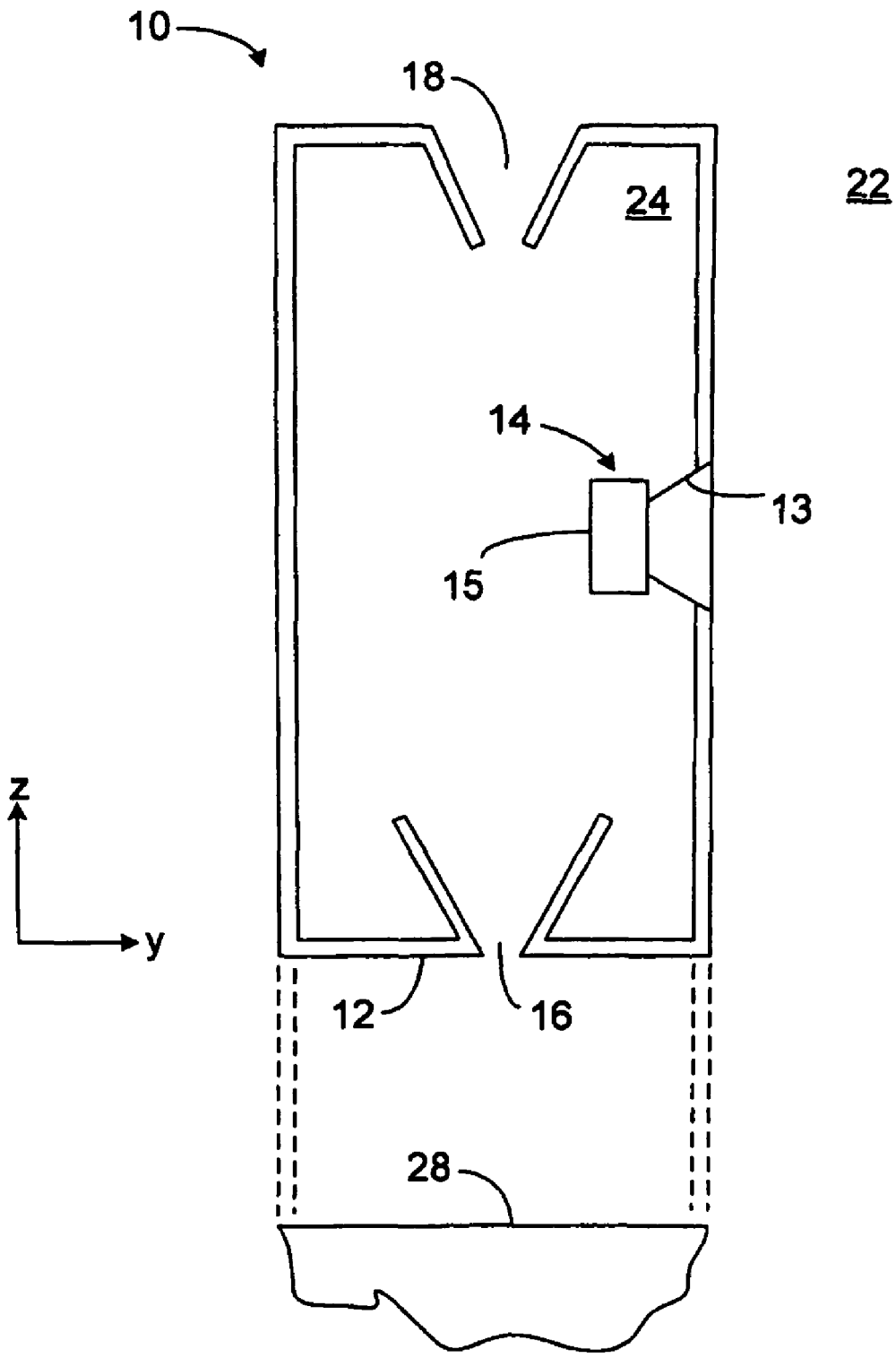
Figure 4F:
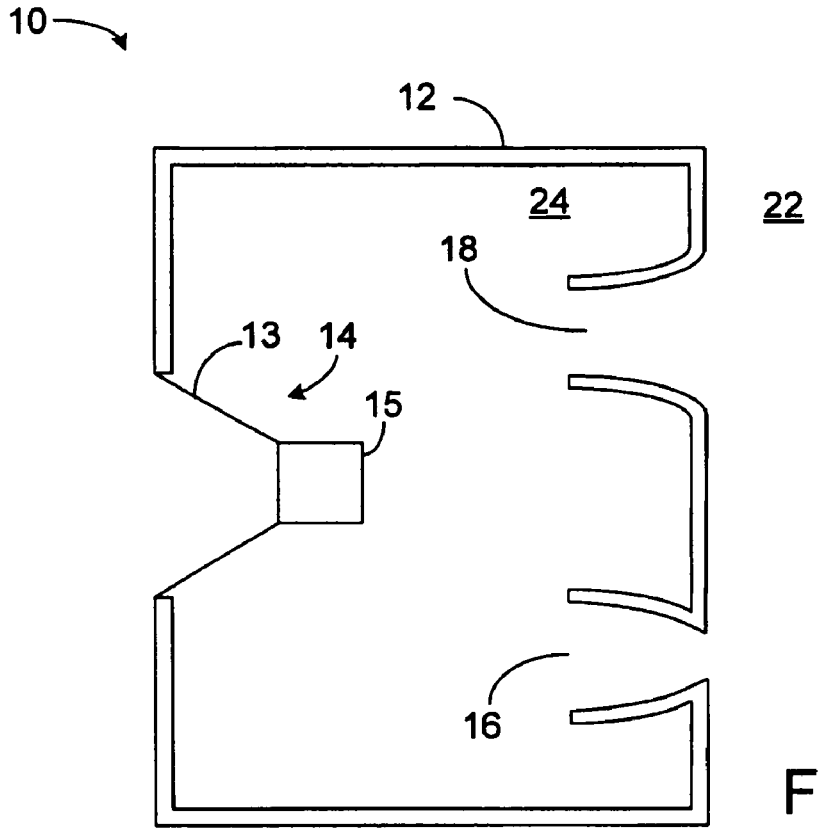
Figure 4G:
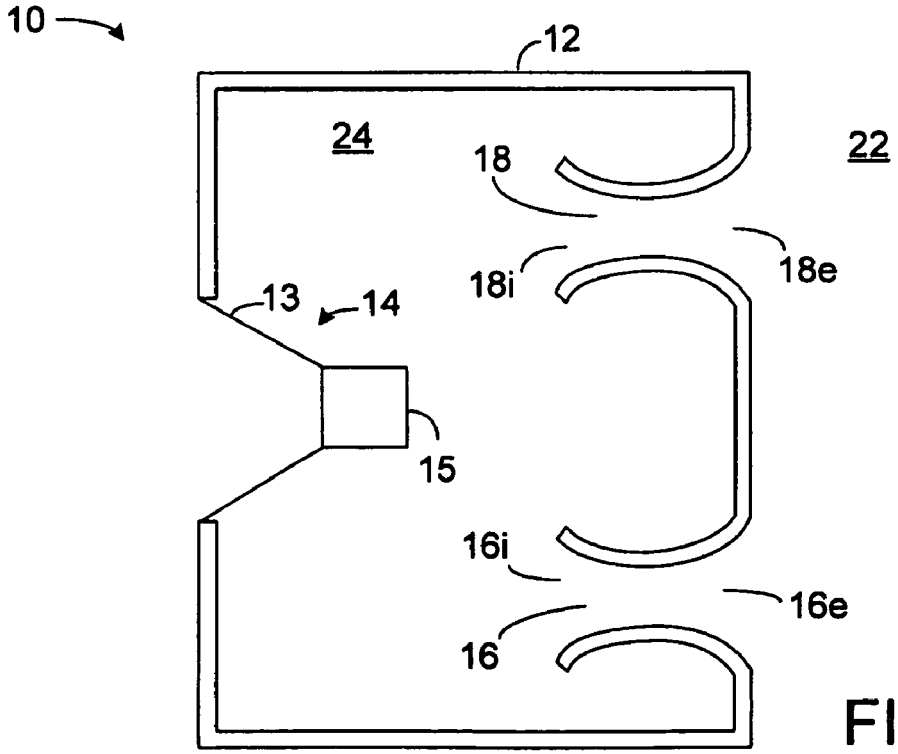
Figure 4H:
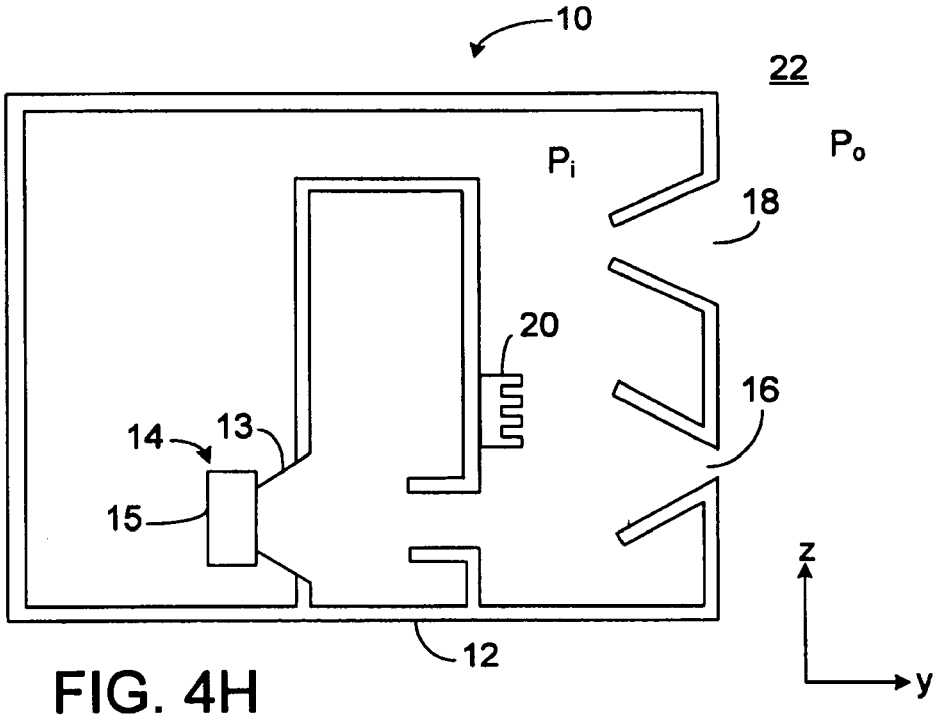
Figure 4I:
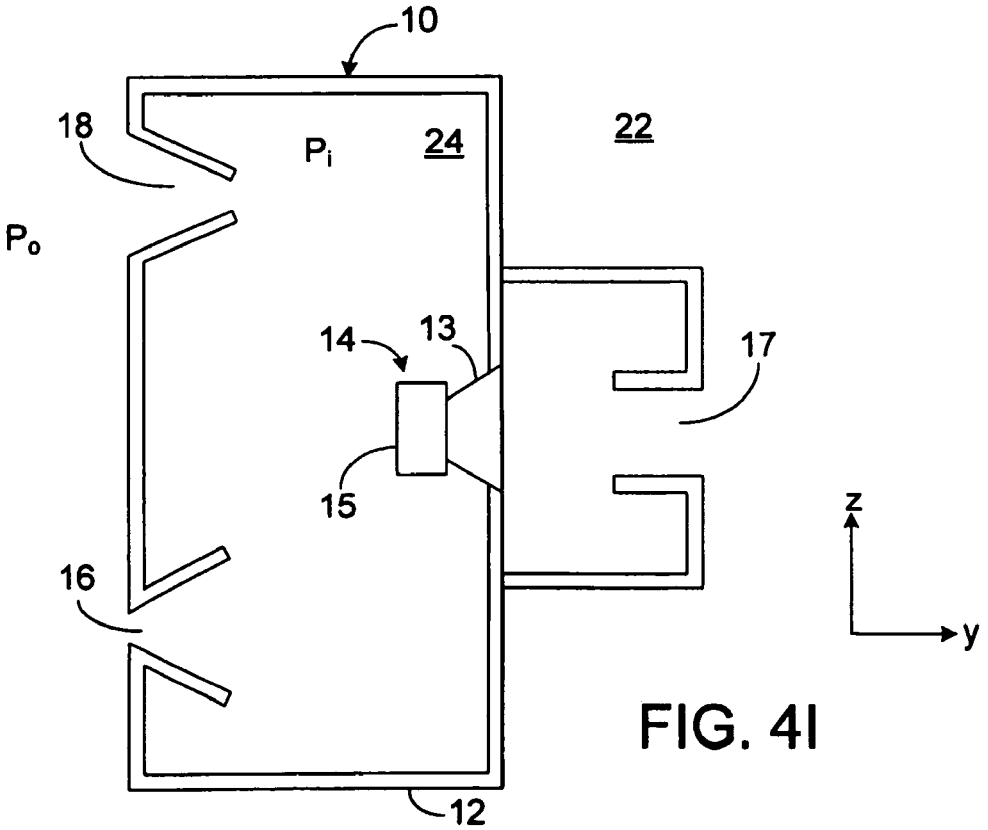
Figure 5:
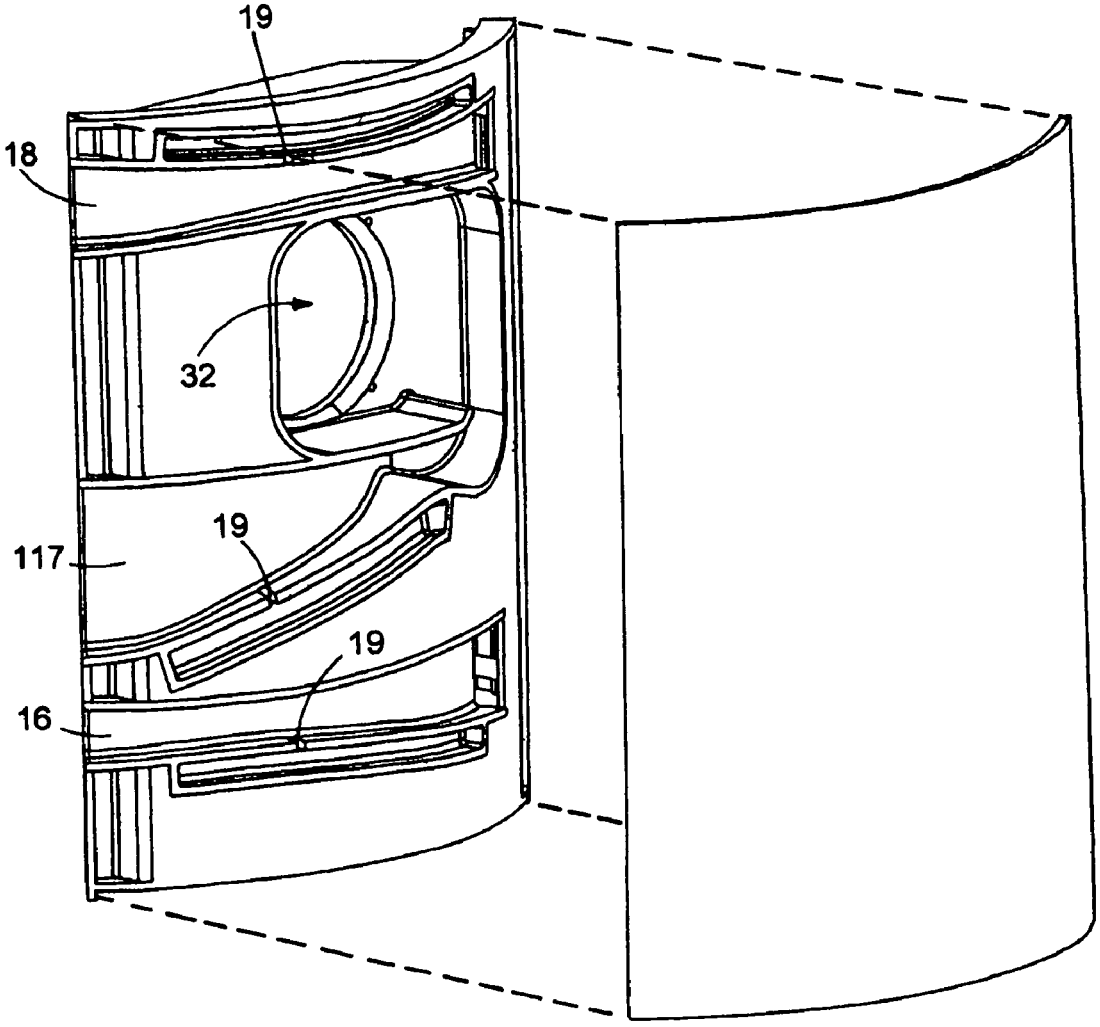
FIG. 5 is a partial blowup of a loudspeaker incorporating the invention.

Referring to FIGS. 4A-4I, several embodiments of the invention are shown. In FIG. 4A, lower port 16 is a straight walled port, and the upper port is flared outwardly. In FIG. 4B, upper port 18 is a straight walled port, and the lower port is flared inwardly. The embodiments of FIGS. 4A and 4B have an airflow similar to the airflow of the embodiment of FIGS. 2 and 3, but the airflow is not as pronounced. In FIG. 4C, it is shown that the ports 16 and 18 can be on different sides of the enclosure 12; if the enclosure has curved sides, the ports 16 and 18 can be at any point on the curve. FIG. 4D is a front view, showing that acoustic driver 14 and the two ports 16 and 18 may be non-collinear. The position of the acoustic driver 14 and alternate locations shown in dashed lines, and the position of ports 16 and 18 and alternate locations shown in dashed lines show that the acoustic driver 14 need not be equidistant from ports 16 and 18 and that the acoustic driver need not be vertically centered between ports 16 and 18. In the embodiment of FIG. 4E, the outwardly flaring upper port 18 is in the upper surface, facing upward, and the inwardly flaring lower port 16 is in the lower surface. If the lower port 16 is in the lower surface as in FIG. 4E, the enclosure would typically have legs or some other spacing structure to space lower port 16 from surface 28 on which loudspeaker 10 rests. FIG. 4F shows that the port walls need not diverge linearly, and that the walls, in cross section, need not be straight lines. The embodiment of FIG. 4G shows that the divergence need not be monotonic, but can be flared both inwardly and outwardly, so long as the cross sectional area at the exterior end 18*e* of the upper port 18 is larger than the cross sectional area at the interior end 18*i*, or so long as the cross sectional area at the exterior end 16*e* of the lower port 16 is smaller than the cross sectional area at the interior end 16*i*, or both. Flaring a port in both directions may have acoustic advantages over straight walled ports or ports flared monotonically. In FIGS. 4H and 4I, the invention is incorporated in loudspeakers with more complex port and chamber structures, and with an acoustic driver that does not radiate directly to the exterior environment. Third port 117 of FIG. 5 is used for acoustic purposes. The operation of the embodiments of FIGS. 4H and 4I causes interior pressure $P_i$ to cycle above and below exterior pressure $P_o$, resulting in a net DC airflow as in the other embodiments, even though acoustic driver 14 does not radiate sound waves directly to the exterior of the enclosure. Aspects of the embodiments of FIGS. 4A-4I can be combined. FIGS. 4A-4I illustrate some of the many ways in which the invention may be implemented, not to show all the possible embodiments of the invention. In all the embodiments of FIGS. 4A-4I, there are an upper port and a lower port, and either the upper port has a net outward flare, or the lower port has a net inward flare, or both.

Referring now to FIG. 5, there is shown a partially transparent view of a loudspeaker incorporating the invention. The cover 30 of the unit is removed to show internal detail of the loudspeaker. The embodiment of FIG. 5 is in the form of FIG. 41. The reference numerals identify the elements of FIG. 5 that correspond to the like-numbered elements of FIG. 41. Acoustic driver 14 (not shown in this view) is mounted in cavity 32. Openings 19 help reduce standing waves in the port tube as described below. The variations in the cross sectional areas of ports 16 and 18 are accomplished by varying the dimensions in the x, y, and z directions. Appendix 1 shows exemplary dimensions of the two ports 16 and 18 of the loudspeaker of FIG. 5.

Figure 6B:
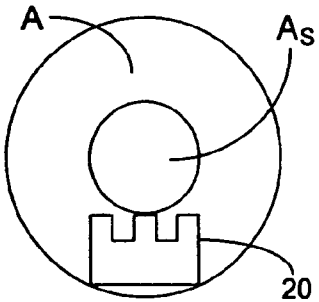
FIGS. 6A and 6B are a diagram of another embodiment of the invention and a cross section viewed along line B-B, respectively.
Figure 6A:
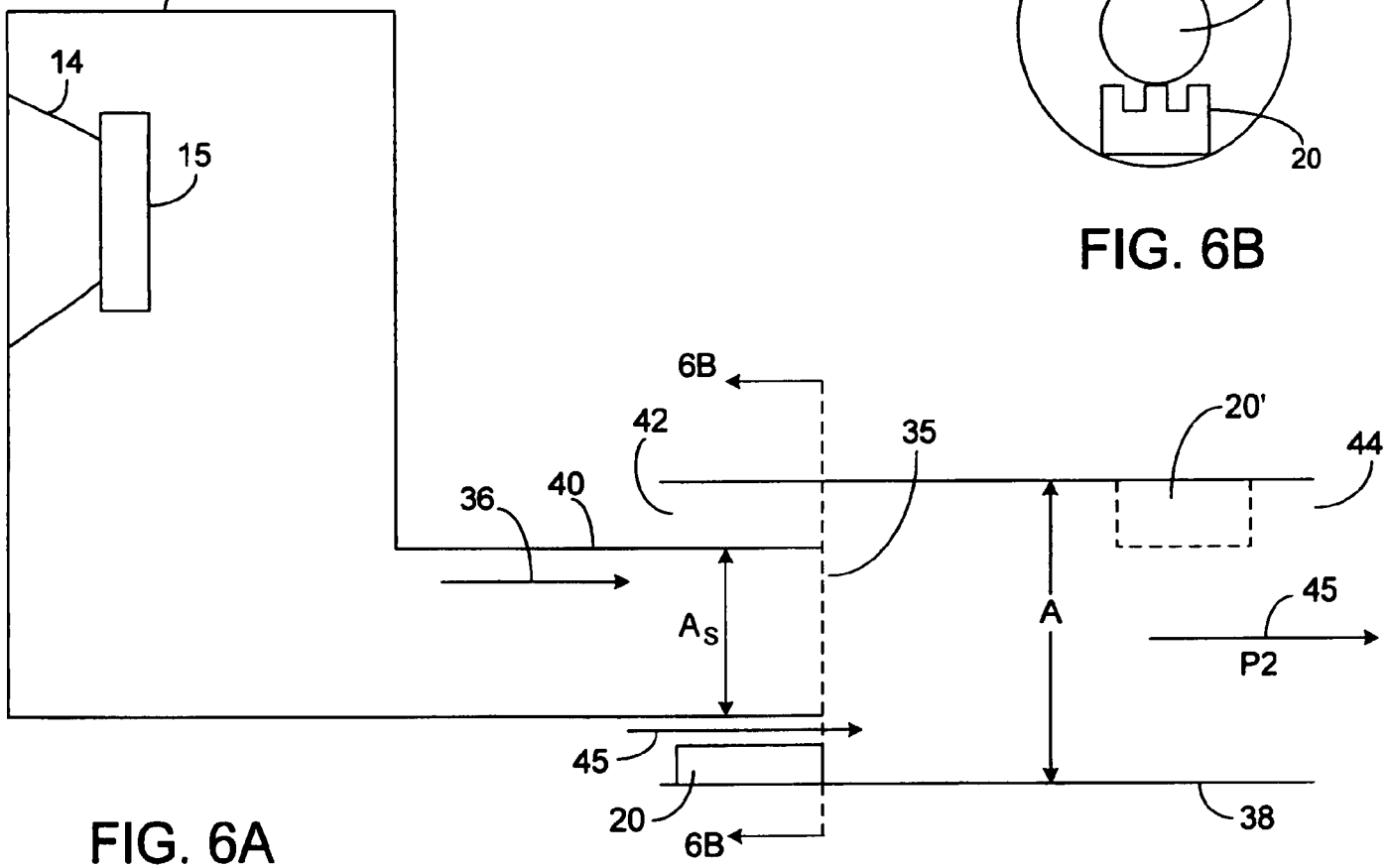

Referring to FIGS. 6A and 6B, there are shown two diagrammatic views of another embodiment of the invention. In FIG. 6A, ported loudspeaker 10 has a port 40 that has a port exit 35 inside airflow passage 38. In one configuration port 40 and airflow passage 38 are both pipe-like structures with one dimension long relative to the other dimensions, and with openings at the two lengthwise ends; port exit 35 has a cross-sectional area $A_s$ smaller than the cross-sectional area A of the airflow passage 38; and port exit 35 is positioned in the airflow passage so that the longitudinal axes are parallel or coincident. Some considerations for the shape, dimensions, and placement of port 40, port exit 35, and airflow passage 38 are presented below. Positioned inside airflow passage 38 is heat producing device 20 or 20', shown at two locations. In an actual implementation, the heat producing device or devices can be placed at many other locations in airflow passage 38.

When acoustic driver 14 operates, it induces an airflow in and out of the port 40. When the airflow induced by the operation of the acoustic driver is in the direction 36 out of the port 40, as shown in FIG. 6A, the port and airflow passage act as a jet pump, which causes airflow in the airflow passage 38 in the same direction as the airflow out of the port, in this example in airflow passage opening 42, through the airflow passage in direction 45 and out airflow passage opening 44. Jet pumps are described generally in documents such as at the internet location http://www.mas.ncl.ac.uk/~sbrooks/book/nish.mit.edu/2006/Textbook/Nodes/chap05/node16.html a printout of which is attached hereto as Appendix 2.

Referring to FIG. 6B, when the acoustic driver induced airflow is in the direction 37 into port 40, there is no jet pump effect. The airflow into the port 40 comes from all directions, including inwardly through airflow passage opening 42. Since the airflow comes from all directions, there is little net airflow within the airflow passage.

To summarize, when the acoustic driver induced airflow is in direction 36, there is a jet pump effect that causes an airflow in airflow passage opening 42 and out passage opening 44. When the acoustic driver induced airflow is in the direction 37, there is little net airflow in airflow passage 38. The net result of the operation of the acoustic driver is a net DC airflow in direction 45. The net DC airflow can be used to transfer heat away from heat producing elements, such as devices 20 and 20', that are placed in the airflow path.

There are several considerations that are desirable to consider in determining the dimensions, shape, and positioning of port 40 and airflow passage 38. The combined acoustic effect of port 40 and passage 38 is preferably in accordance with desired acoustic properties. It may be desirable to arrange port 40 to have the desired acoustic property and airflow passage 38 to have significantly less acoustic effect while maintaining the momentum of the airflow in desired direction 45 and to deter momentum in directions transverse to the desired direction. To this end port 40 may be relatively elongated and with a straight axis of elongation parallel to the desired momentum direction. It may be desirable to structure airflow passage 38 to increase the proportion of the airflow is laminar and decrease the proportion of the airflow that is turbulent while providing a desired amount of airflow.

Figure 7:
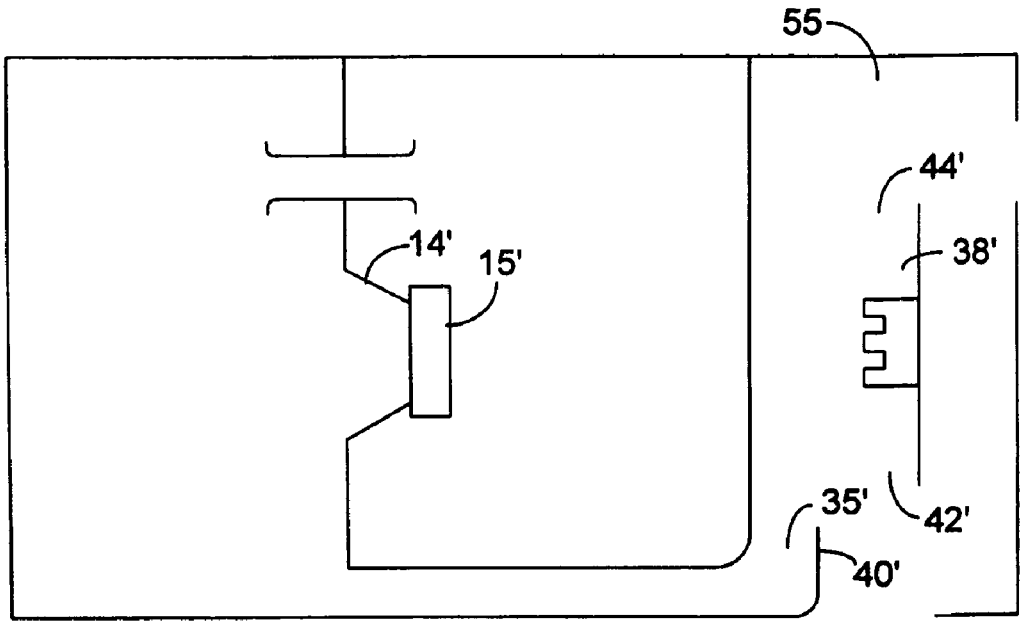
FIG. 7 is a diagrammatic view of an implementation of the embodiment of FIGS. 6A and 6B.

Referring to FIG. 7, there is shown a mechanical schematic drawing of an actual test implementation of the embodiment of FIGS. 6A and 6B, the elements numbered similarly to the corresponding elements of FIGS. 6A and 6B. In the test implementation device the airflow passage 38 and the heat producing device were both parts of a unitary structure. A resistor was placed in thermal contact with at heat sink in a tubular form with appropriate dimensions so it could function as the airflow passage 38. With current flowing through the resistor and with acoustic driver 14 not operating, the temperature in the vicinity of the heatsink rose 47° C. With the acoustic driver operating at ⅛ power, the temperature in the vicinity of the heatsink rose 39° C. With the acoustic driver operating at ⅓ power radiating pink noise, the temperature in the vicinity of the heatsink rose 25° C. Additionally, the thermal effect of the device at other points in the loudspeaker enclosure was measured. For example, at area 55, convection heating caused the temperature to rise 30.5° C. with current flowing through the resistor and with acoustic driver 14 not operating. With the acoustic driver operating at ⅓ power, the temperature in the vicinity of the heatsink rose 30.5° C. With the acoustic driver operating at ⅛ power radiating pink noise, the temperature in the vicinity of the heatsink rose 30.5° C. With the acoustic driver operating at ⅓ power radiating pink noise, the temperature in the vicinity of the heatsink rose 21° C. This indicates that if the acoustic driver operates at high enough power, thereby moving more air than when it operates at lower power, the airflow resulting from a loudspeaker according to the invention transfers heat from areas near, but not directly in, the airflow.

Figure 8:
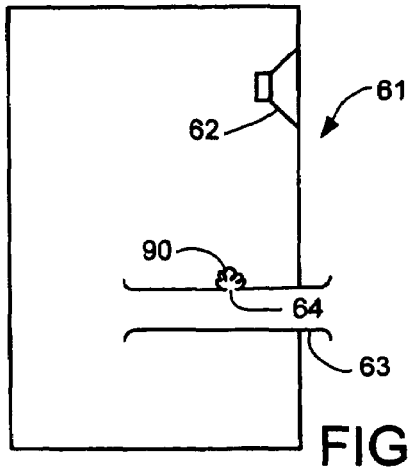
FIG. 8 is a diagrammatic representation of a loudspeaker enclosure with a vented port tube according to the invention.

Referring to FIG. 8, there is shown a diagrammatic representation of a loudspeaker enclosure 61 having a driver 62 and a port tube 63 formed with a vent 64 typically located at a point along the length of port tube 63 corresponding to the pressure maximum of the dominant standing wave established in port tube 63 when driver 62 is excited to reduce audible port noise. Acoustic damping material 90, for example polyester or cloth, may be positioned in or near vent 64.

This aspect of the invention reduces the objectionability of port noise caused by self resonances. For example, consider the case of increased noise at the frequency for which one-half wavelength is equal to the port length. In this example of self resonance, the standing waves in the port tube generate the highest pressure midway between the ends of port tube 63. By establishing a small resistive leak near this point with vent 64 in the side of the tube, the Q of the resonance is significantly diminished to significantly reduce the objectionability of port noise at this frequency. The acoustic damping material 90 may further reduce the Q of high frequency resonances.

Figure 9:
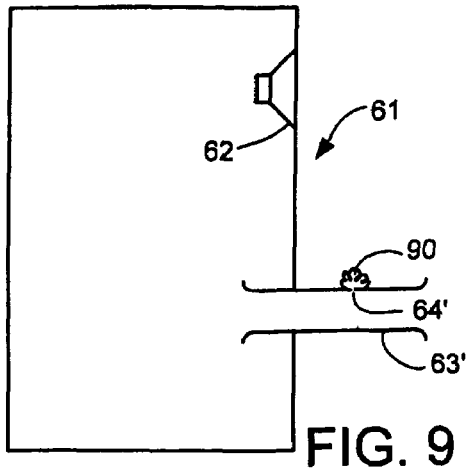
FIG. 9 shows a form of the invention with the port tube vented outside the enclosure.
Figure 10:
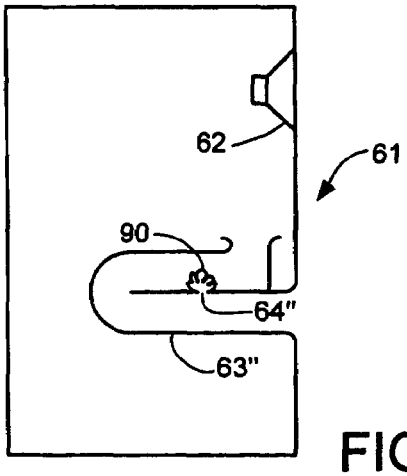
FIG. 10 shows a form of the invention with the port tube vented to another portion of the port tube.
Figure 11:
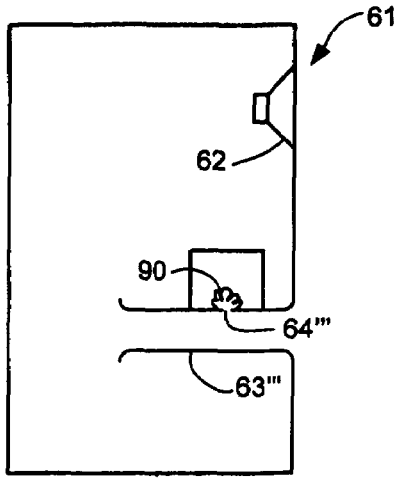
FIG. 11 shows a form of the invention with the port tube vented into a small volume.

The leak can occur through vent 64 into the acoustic enclosure as shown in FIG. 8. Alternatively, the leak can leak into the space outside enclosure 61 through vent 64' of port tube 63' as shown in FIG. 9. The port tube 63" could leak through vent 64" to a different part of port tube 63" as shown in FIG. 10. Port tube 63''' could leak through vent 64''' into a small volume 65 as shown in FIG. 11. The port tube 63''' could leak through vent 64''' into a closed end resonant tube 65'. In the embodiments of FIGS. 9-12, there may be positioned near the vent 64'-64''' acoustic damping material 90.

Figure 12:
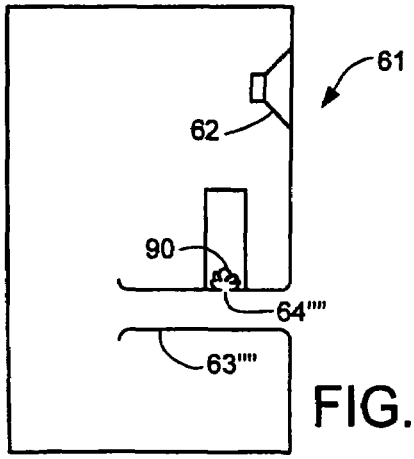
FIGS. 12 and 13 show forms of the invention with the port tube vented into a closed end resonant tube.

An advantage of the embodiments of FIGS. 11 and 12 is that the disclosed structure may have insignificant impact on the low frequency output. The acoustic damping material 90 may further reduce the Q of high frequency resonances.

The structures shown in FIGS. 9-12 reduce the Q of the self resonance corresponding to the half-wave resonance of the port tube. The principles of the invention may be applied to reducing the Q at other frequencies corresponding to the wavelength resonance, 3/2 wavelength resonance and other resonances. To reduce the Q at these different resonances, it may be desirable to establish vents at points other than midway between the ends of the port tubes. For example, consider the wavelength resonance where pressure peaks at a quarter of the tube length from each end. A vent at these locations is more effective at diminishing the Q of the wavelength resonance than a vent at the midpoint of the tube. Vents at these points and other points may furnish leakage flow to the same small volume for the midpoint vent. Alternatively, each may have dedicated closed end resonant tubes. Still alternatively, they may allow leakage to the inside or outside of the enclosure. To reduce the audible output at a variety of resonances, a multiplicity of vents may be used, including a slot, which can be considered as a series of contiguous vents.

There are numerous combinations of venting structures, structures defining volumes for venting, including resonant closed end tubes.

Figure 13:
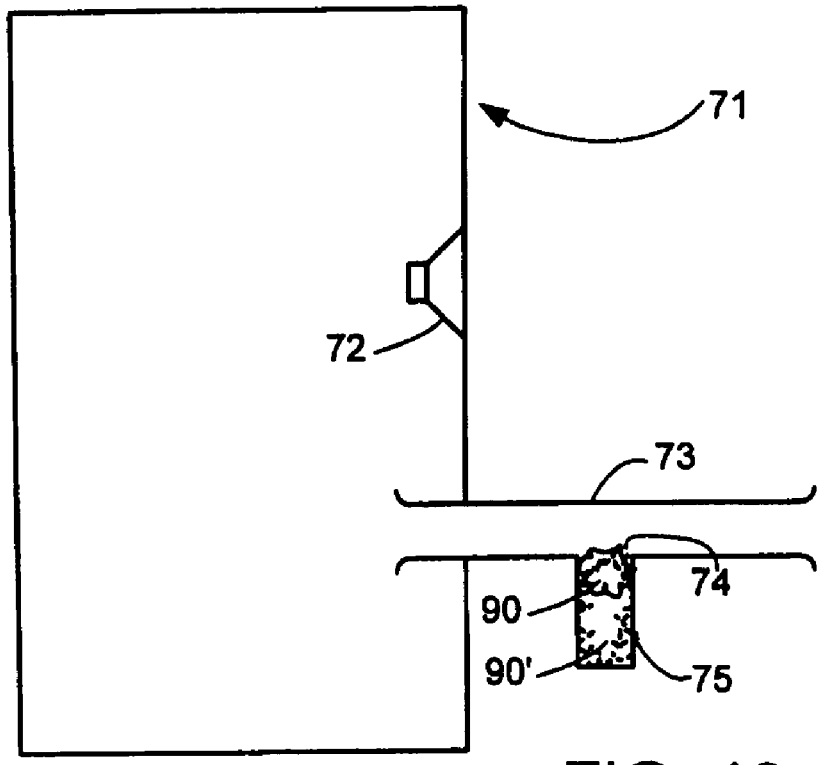
Figure 14:
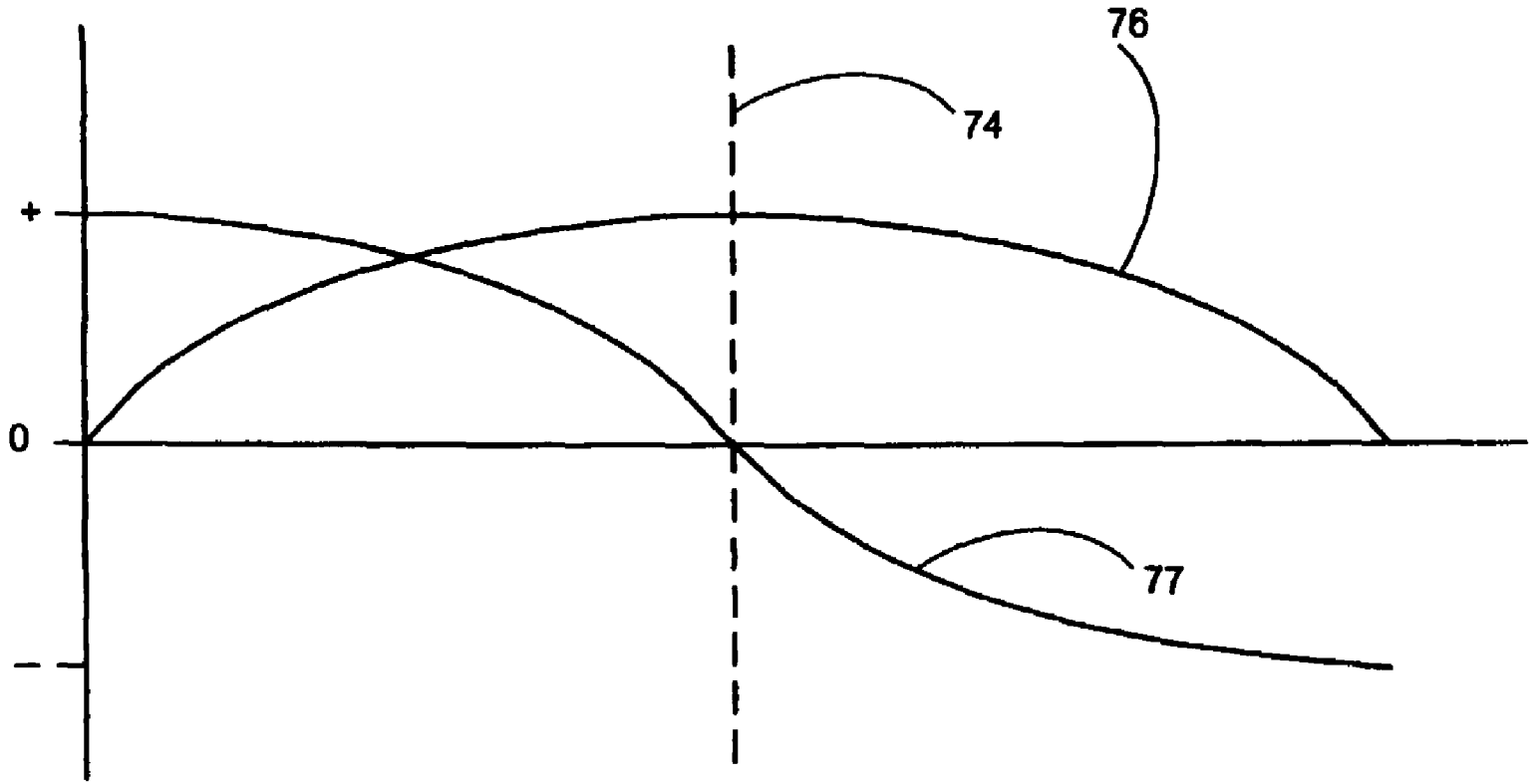
FIG. 14 shows standing wave patterns in the port tube.

Referring to FIG. 13, there is shown a schematic representation of an embodiment of the invention for reducing Q of the half-wave resonance of a port tube 73 of length A1 in enclosure 71 having driver 72 using tube 75 with a closed end of length 0.3 A1 having its open end at vent 74. FIG. 14 shows the standing wave for the half-wave resonance along the length of tube 73 (in the absence of resonant tube 75), showing the pressure distribution 76 and the volume velocity distribution 77. The pressure is at a maximum at point 74. Energy from the standing wave in the port tube 73 is removed from the port tube. The energy may be dissipated by damping material 90 in the resonant tube, significantly reducing the Q of the half-wave resonance.

In the resonant tube 75 may be acoustic damping material. The acoustic damping material may fill only a small portion of the resonant tube 75 as indicated by acoustic damping material 90, or may substantially fill resonant tube as indicated in dotted line by acoustic damping material 90'. The acoustic damping material 90 or 90' reduces the Q of high frequency multiples of the of the half-wave resonant frequency.

Figure 15:
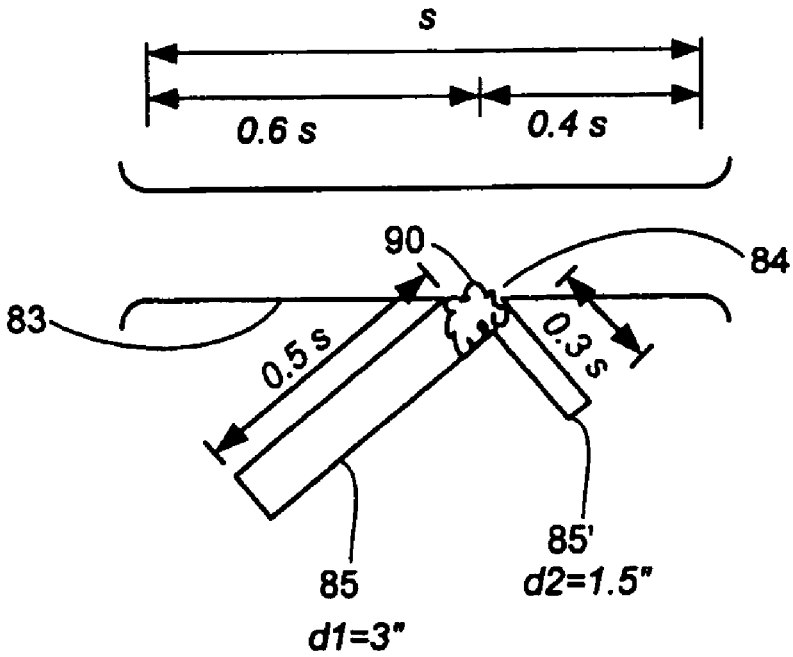
FIG. 15 shows a form of the invention with the vent asymmetrically located and loaded by closed end tubes of different lengths.

Referring to FIG. 15, there is shown a diagrammatic representation of a port tube 83 with a vent 84 six-tenths of the port tube length s from the left end and four-tenths of the port tube length from the right end terminated in a closed end resonant tube 85 of length 0.5 the length of port tube 83 and diameter d1 of 7.5 cm (3 inches) and another closed end tube 85' of length 0.25 that of port tube 83 and diameter d2 of 3.8 cm. (1.5 inches). In one or both of closed end resonant tube 85 and closed end resonant tube 85' may be acoustic damping material 90. As with the embodiment of FIG. 13, the acoustic damping material may fill a portion of one or both of closed end resonant tubes 85, 85', or may substantially completely fill one or both of close end resonant tubes 85, 85'.

It is evident that those skilled in the art may now make numerous uses and modifications of and departures from the specific apparatus and techniques disclosed herein without departing from the inventive concepts. Consequently, the invention is to be construed as embracing each and every novel feature and novel combination of features present in or possessed by the apparatus and techniques disclosed herein and limited only by the spirit and scope of the appended claims.

The invention claimed is:

1. An electroacoustical device comprising:

a loudspeaker enclosure including a first acoustic port having an interior end and an exterior end, each end having a cross sectional area wherein the cross sectional area of the interior end is smaller than the cross sectional area of the exterior end, the first acoustic port mounted in a first opening in the enclosure;

a second acoustic port having an interior end and an exterior end, each end having a cross sectional area, the second acoustic port mounted in a second opening in the enclosure lower than the first opening;

an acoustic driver mounted in said loudspeaker enclosure;

a heat producing device, heating surrounding air, positioned in said enclosure and causing a convective airflow;

said acoustic driver and said cross sectional area of said interior end and said exterior end of said first acoustic port and said cross sectional area of said interior end and said exterior end of said second acoustic port constructed and arranged so that the operation of said acoustic driver coacts with said first acoustic port and said second acoustic port to provide, exclusive of said convective airflow and without any augmentation from an airflow movement device, a cooling substantially unidirectional airflow in substantially the same direction as said convective airflow across said heat producing device thereby transferring heat from said heat producing device.

2. An electroacoustical device comprising:

a loudspeaker enclosure including a first acoustic port having an interior end and an exterior end, each end having a cross sectional area wherein the cross sectional area of the interior end is larger than the cross sectional area of the exterior end, the first acoustic port mounted in a first opening in the enclosure;

a second acoustic port having an interior end and an exterior end, each end having a cross sectional area, the second acoustic port mounted in a second opening in the enclosure higher than the first opening;

an acoustic driver mounted in said loudspeaker enclosure;

a heat producing device, heating surrounding air, positioned in said enclosure and causing a convective airflow;

said acoustic driver and said cross sectional area of said interior end and said exterior end of said first acoustic port and said cross sectional area of said interior end and said exterior end of said second acoustic port constructed and arranged so that the operation of said acoustic driver coacts with said first acoustic port and said second acoustic port to provide, exclusive of said convective airflow and without any augmentation from an airflow movement device, a cooling substantially unidirectional airflow in substantially the same direction as said convective airflow across said heat producing device thereby transferring heat from said heat producing device.

* * * * *